United States Patent [19]

Clement et al.

[11] Patent Number: 4,584,982

[45] Date of Patent: Apr. 29, 1986

[54] ARRANGEMENT FOR A FUEL METERING SYSTEM FOR AN INTERNAL COMBUSTION ENGINE

[75] Inventors: Albrecht Clement, Kornwestheim; Dieter Mayer, Stuttgart; Ernst Wild, Weissach-Flacht, all of Fed. Rep. of Germany

[73] Assignee: Robert Bosch GmbH, Stuttgart, Fed. Rep. of Germany

[21] Appl. No.: 667,019

[22] Filed: Nov. 1, 1984

[30] Foreign Application Priority Data

Nov. 12, 1983 [DE] Fed. Rep. of Germany ..... 3341015

[51] Int. Cl.[4] ..... F02M 51/00; F02M 7/00

[52] U.S. Cl. ..... 123/489; 123/440

[58] Field of Search ..... 123/440, 480, 489

[56] References Cited

U.S. PATENT DOCUMENTS

| | | | |
|---|---|---|---|
| 4,203,394 | 5/1980 | Aono et al. | 123/440 |
| 4,319,327 | 3/1982 | Higashiyama et al. | 123/480 X |
| 4,413,601 | 11/1983 | Matsuoka et al. | 123/440 X |
| 4,440,131 | 4/1984 | Felger et al. | 123/440 |

*Primary Examiner*—Tony M. Argenbright

*Attorney, Agent, or Firm*—Walter Ottesen

[57] ABSTRACT

The invention is directed to an arrangement for a fuel metering system for an internal combustion engine. The arrangement includes a computer unit for generating a fuel metering signal in dependence on the operating parameters of the internal combustion engine. The arrangement includes an oxygen sensor and a filter to which the sensor signal is applied, and a subsequent evaluation circuit for additionally influencing the fuel metering signal, preferably in a multiplicative manner. The filter output quantity and engine speed information are utilized together for an additional additive speed-dependent and an additive speed-independent influencing of the fuel metering signal via at least one control function. This arrangement permits a nearly ideal anticipatory control of the fuel metering signal which has an advantageous effect on the engine operating behavior and the exhaust gas quality, in particular with the internal combustion engine in a state of transition and the lambda control circuit deactivated.

7 Claims, 3 Drawing Figures

ARRANGEMENT FOR A FUEL METERING SYSTEM FOR AN INTERNAL COMBUSTION ENGINE

FIELD OF THE INVENTION

The invention relates to an arrangement for a fuel metering system in an internal combustion engine wherein computer means generates a fuel metering signal in dependence upon operating parameters of the internal combustion engine such as air quantity, intake air pressure or load and engine rotational speed or also temperature. Oxygen sensor means forms a sensor signal indicative of the oxygen content of the exhaust gases of the engine and an evaluation circuit is connected to the output sensor means for influencing the fuel metering signal.

BACKGROUND OF THE INVENTION

Control systems for controlling the excess-air factor lambda (λ) have been known for a long time and are described in pertinent literature in detail. Particularly, German published patent application DE-OS No. 3,036,107 (U.S. Pat. No. 4,440,737) discloses an adaptive lambda control arrangement for a fuel metering system for an internal combustion engine wherein, in addition to the already existing control system, multiplicative and additive correction quantities are formed and stored in nonvolatile memory stores. In the lower part-load range and at idling, the control arrangement permits an additive, and in the upper part-load range and under full-load conditions, a multiplicative regulation of the lambda shift.

By these means, the anticipatory control of the lambda value is gradually adapted to the varying operating parameters of the internal combustion engine. This special type of adaptation as disclosed in DE-OS No. 3,036,107 is based on the realization that in the anticipatory control of the lambda value substantially additive errors occur at a low load of the internal combustion engine, whereas the errors are substantially multiplicative at a high load of the internal combustion engine.

Additive errors may be caused especially by so-called leakage air portions which are portions of air that are not detected by the load sensor, for example, an air flow sensor. Multiplicative errors may result from temperature or pressure variations, for example, relating to the density of the fuel or the intake air quantity. Thus, such an adaptation of the anticipatory control obviates the need for an altitude sensor since altitude-dependent density errors are compensated for automatically.

On the whole, this arrangement has proven to be satisfactory although for some operating ranges of the internal combustion engine optimum conditions are not yet present. As investigations have shown, a further drift possibility which is not covered by the two above-described correcting possibilities must not be neglected. The reason for this is that the known control arrangement only considers additive speed-independent errors. Although in the event of an additive speed-dependent error, the control system is in a position to correct the error for a specific predetermined speed, the correction value just determined will no longer be correct when moving into a new speed range so that the correction procedure starts anew. In general, however, the engine speed varies so rapidly that the adaptive adjustment with its relatively large control time constant falls out of step. Emission tests have shown that such an error may mislead the adaptive control, causing the exhaust gas to become less clean than would be the case without adaptive control.

SUMMARY OF THE INVENTION

The arrangement for a fuel metering system of the invention for an internal combustion engine affords an optimum adaptation of the anticipatory control of the Lambda value. By introducing a further speed-dependent correction of the anticipatory control values, the invention also permits the compensation of errors that are of an additive speed-dependent nature. Such additive speed-dependent errors may occur, for example, as a result of wear-induced long-term drifts on the fuel metering devices. The merit of the invention is already evident at this point in that these functional dependences of the error sources are realized.

In particular, in internal combustion engines having solenoid-operated injection valves, deposits and erosions on the injection valves which adversely affect their operation may be the cause of such errors. Further, such errors may also result from an incorrect voltage correction on the injection valves which is necessary because of the different operate and release times of the valves.

It is therefore an object of the arrangement of the invention to improve the operation and the exhaust gas quality of lambda-controlled internal combustion engines.

Further advantages and improvements of the invention will become apparent from the subsequent description in conjunction with the drawing and from the claims.

BRIEF DESCRIPTION OF THE DRAWING

The invention will now be explained in more detail in the following with reference to the drawing wherein.

DESCRIPTION OF THE PREFERRED EMBODIMENTS OF THE INVENTION

Figure 1:
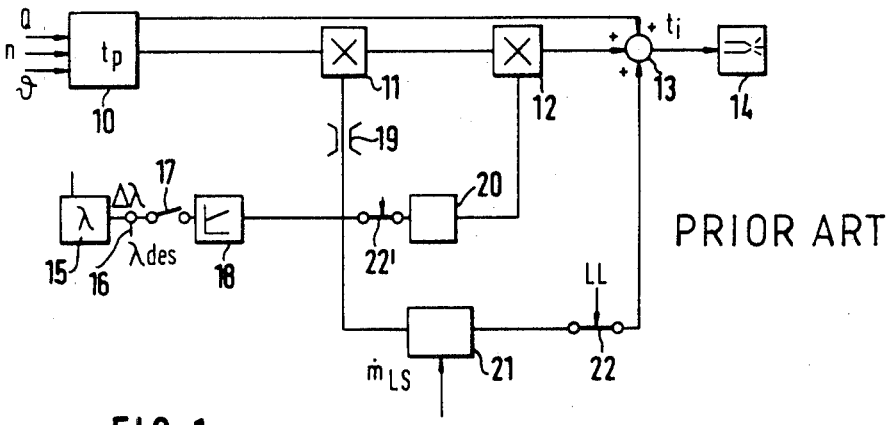
FIG. 1 is a simplified block diagram of a prior art lambda control arrangement.

FIG. 1 illustrates a block diagram of a state-of-the-art lambda control arrangement for an internal combustion engine. Reference numeral 10 identifies a timing element having an input to which the essential operating parameters of the internal combustion engine are applied. Its output is fed to two multipliers 11, 12 connected in series. Multiplier 12 is followed by an adder 13 the output of which is applied to injection valves 14 of an internal combustion engine (not shown). An oxygen sensor 15 provided in the exhaust pipe (not shown) of the internal combustion engine is connected to a control unit 18 via a comparator 16 and a switch 17. The output signals of control unit 18 are applied to multiplier 11 via a limiter 19, to multiplier 12 via a switch 22' and a control stage 20, and to adder 13 via a correction stage 21 and a switch 22.

The operation of the arrangement of FIG. 1 will now be described.

On the basis of operating characteristic quantities such as inducted air Q, engine speed n and temperature $\theta$ of the internal combustion engine, a pulse-duration modulated signal $t_p$ is formed in timing element 10. Via subsequent multipliers 11, 12 as well as via adder 13, this signal is corrected substantially in dependence upon the output signal of oxygen sensor 15. The intervention into fuel metering via multiplier 11 enables the air-fuel mixture to be regulated to a predetermined value with the internal combustion engine in the stationary mode.

The output signal of control unit 18 is, however, used additionally for regulating the control unit intervention to a symmetrical spacing for limiting as well as for additive correction in the lower load range and at idling. Regulating the control unit intervention to a symmetrical spacing for limiting corresponds to a mean value shift which is accomplished by means of control stage 20. This stage operates only when the lambda control is enabled and its output acts on multiplier 12. The additive correction in the lower load range of the internal combustion engine is made possible by correction stage 21 via switch 22 and adder 13, for example. In the present special case, switch 22 is only actuated at idling or in the lower load range. The correction values for multiplier 12 and adder 13 are stored in memory stores not shown and remain effective also in other operating ranges of the internal combustion engine.

Figure 2:
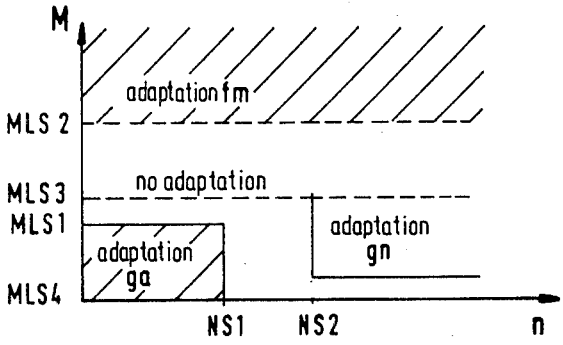
FIG. 2 is a characteristic field explaining the mode of operation of the arrangement of the invention; and, FIG. 3 is a schematic of an embodiment of the arrangement of the invention.

FIG. 2 is a schematic illustration of the adaptation areas of the arrangement of the invention in dependence on load M and speed n of the internal combustion engine. Above a load threshold MLS2, the multiplicative correction value fm continues to be adjusted until the correction factor of multiplier 11 assumes the neutral value of unity (1). Below a load threshold MLS1 and below a speed threshold NS1, the additive speed-independent factor ga is adapted. Such a procedure for adaptation of the anticipatory control is known, for example, from DE-OS No. 3,036,107 referred to initially.

It has been shown that this two-parameter correction of the anticipatory control does not always result in an optimum operation of the internal combustion engine. Accordingly, it is the essence of the invention to introduce a third correction value gn which acts on the anticipatory control additively in proportion to engine speed. The load-speed area in which this value gn is corrected lies between load thresholds MLS3 and MLS4 as well as above an engine speed NS2. Threshold MLS4 which precludes an adaptation of value gn in very low load ranges was introduced because of driving requirements—in this range the combustion of the air-fuel mixture is very poor. In all other operating ranges of the internal combustion engine, no adaptation of these correction values is performed. It is to be noted, however, that these correction values are effective in all operating ranges of the internal combustion engine.

For clarification of the terms additive speed-independent and additive speed-dependent, it is to be understood that these terms relate to the amount of fuel metered per unit of time and not the amount of fuel metered per injection.

Figure 3:
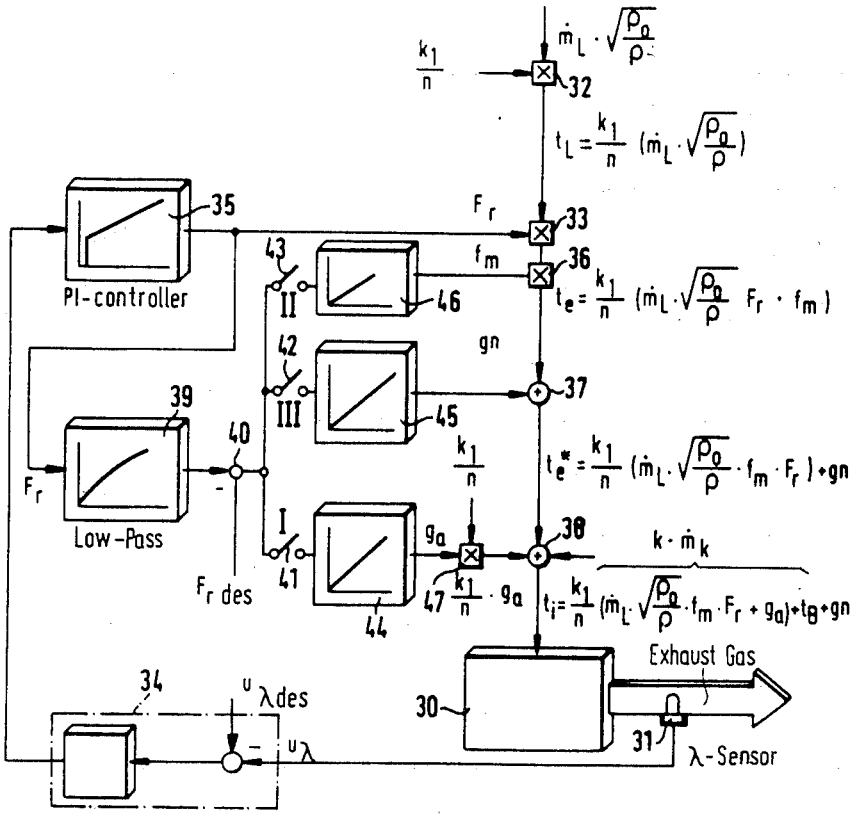

FIG. 3 illustrates an embodiment of the arrangement of the invention in greater detail. Reference numeral 30 identifies an internal combustion engine wherein a lambda sensor 31 is exposed to exhaust gas. The fuel metering signal of the internal combustion engine, which in this embodiment is a spark-ignition engine with fuel injection, is produced in a multiplier 32 from the output signal of a load sensor, for example, an air flow sensor, and the engine speed. This duration of injection $t_L$ is provided with correction factor $F_r$ via the conventional Lambda control circuit which includes a comparator 34, a control unit 35 and multiplier 33.

A multiplier 36 and adders 37 and 38 also act on the duration of injection for adaptation of the anticipatory control. For this purpose, the output signal $F_r$ of control unit 35 is smoothed in a low-pass filter 39, compared with a desired value $F_{rdes}$ in a comparator 40 and then supplied to three control units 44, 45 and 46 via switches 41, 42 and 43, respectively. In this arrangement, control unit 44 is connected to adder 38 via a multiplier 47 receiving engine speed information and via memory stores not shown. In the same manner, control unit 45 is connected to adder 37 and control unit 46 is connected to multiplier 36 via memory stores not shown.

The mode of operation of the arrangement according to the invention will now be described.

In the event of a high output of the internal combustion engine in which the amount of air inducted exceeds threshold MLS2, switch 43 is closed while switches 41 and 42 remain open. Control unit 46 for the multiplicative factor fm continues to be adjusted until the mean value of the output quantity of control unit 35 corresponds to the reference quantity applied to comparator 40 and preferably assuming the neutral value of unity.

By contrast, if the output of the internal combustion engine is in the range of values characterized by an inducted air quantity between thresholds MLS3 and MLS4, and if at the same time the engine speed is above threshold NS2, switch 42 will be closed while switches 41 and 43 will be opened. This additive speed-proportional correction value gn will be likewise adjusted until the mean output quantity of control unit 35 corresponds to the predetermined desired quantity $F_{rdes}$ applied to comparator 40.

In the event of a low output of the internal combustion engine which is below threshold MLS1 and at low engine speeds which are below threshold NS1, only switch 41 is closed. In this case, the additive speed-independent correction value ga is adjusted. Since this correction value is to correspond to a constant fuel quantity per unit of time, in this particular case, however, acting on the duration of injection per injection, a multiplier 47 applies an additional quantity inversely proportional to the engine speed to value ga.

Since the reactions to be compensated for are processes which vary slowly with time, control units 44, 45 and 46 are allocated a relatively high time constant which may extend as far as into the minute range. As tests of the arrangement of the invention have shown, excellent results were achieved in adjusting the anticipatory control of the duration of injection to the changing parameters of the internal combustion engine. Factor $F_r$, which characterized the direct influence of the superposed lambda control, generally assumes the value of unity and deviates from this value only for a short time, if at all. This anticipatory control is of great importance particularly with the internal combustion engine in an operating condition in which either the lambda sensor is not in a ready state or the retardation of the controlled system, especially in transition areas of the internal combustion engine, plays a dominant part. In this event, the quality of the exhaust gas and the operating behavior of the internal combustion engine are exclusively determined by the anticipatory control. The arrangement described permits a substantial improvement in the anticipatory control of fuel metering.

Whereas the invention has been explained with reference to a block diagram using individual components for ease of understanding, it is to be understood that the arrangement of the invention can be readily implemented with suitable microcomputer software tools. Such an embodiment presents no problem to the expert in the field of fuel metering for internal combustion engines, the less so since, on the one hand, the expertise of data processing specialists may be drawn on at any time and, on the other hand, such an embodiment is already disclosed, for example, in DE-OS No. 3,036,107.

It is understood that the foregoing description is that of the preferred embodiments of the invention and that various changes and modifications may be made thereto without departing from the spirit and scope of the invention as defined in the appended claims.

What is claimed is:

1. An arrangement for a fuel metering system for an internal combustion engine, the arrangement comprising:

computer means for generating a fuel metering signal in dependence upon operating parameters of an internal combustion engine such as air quantity, intake air pressure or load, engine rotational speed or also temperature;

oxygen sensor means for forming a sensor signal indicative of the oxygen content of the exhaust gases of the engine;

evaluation means connected to the output of said oxygen sensor means for at least one of directly and indirectly multiplicatively influencing said fuel metering signal;

filter means for receiving said sensor signal and for providing a filter output quantity; and, control means for utilizing said filter output quantity and engine speed information to additionally additively speed-dependently and additively speed-independently influence said fuel metering signal.

2. The arrangement of claim 1, comprising means for optimizing the quantities for additively influencing said fuel metering signal in dependence upon the operating range of the internal combustion engine with respect to said mutiplicative influence.

3. The arrangement of claim 2, said quantities for additively influencing said fuel metering signal being optimized in the idle speed range or in the partial load range of the internal combustion engine.

4. The arrangement of claim 2, said quantities for additively speed-independently influencing said fuel metering signal being optimized for rotational speeds of the engine below a threshold NS1.

5. The arrangement of claim 2, the quantities for additively speed-dependently influencing said fuel metering signal being optimized for a rotational speed of the engine above a threshold NS2.

6. The arrangement of claim 2, the quantities for additively influencing being optimized with respect to the multiplicative influence in such a manner that the direct multiplicative influence is substantially neutralized.

7. The arrangement of claim 1, the additive influence of said fuel metering signal being effective over the entire operating range of the internal combustion engine.

* * * * *

UNITED STATES PATENT AND TRADEMARK OFFICE

CERTIFICATE OF CORRECTION

PATENT NO. : 4,584,982

DATED : April 29, 1986

INVENTOR(S) : Albrecht Clement, Dieter Mayer and Ernst Wild

It is certified that error appears in the above-identified patent and that said Letters Patent is hereby corrected as shown below:

In column 1, line 24: delete "No. 4,440,737" and substitute -- No. 4,440,131 -- therefor.

In column 3, line 1: delete "θ" and substitute -- $\vartheta$ -- therefor.

In column 6, line 11: delete "mutiplicative" and substitute -- multiplicative -- therefor.

Signed and Sealed this

*Twenty-sixth* Day of *August 1986*

[SEAL]

*Attest:*

DONALD J. QUIGG

*Attesting Officer*

*Commissioner of Patents and Trademarks*